United States Patent [19]

Brown

[11] Patent Number: 4,738,447

[45] Date of Patent: Apr. 19, 1988

[54] BASKETBALL PLAYER'S TRAINING GLOVE

[76] Inventor: Darryl L. Brown, 349 E. Piru St., Los Angeles, Calif. 90061

[21] Appl. No.: 20,359

[22] Filed: Mar. 2, 1987

[51] Int. Cl.[4] ..... A63B 69/00

[52] U.S. Cl. ..... 273/1.5 A; 2/161 A

[58] Field of Search ..... 273/1.5 A, 54 B; 2/161 A, 160, 166

[56] References Cited

U.S. PATENT DOCUMENTS

| | | | |
|---|---|---|---|
| 889,397 | 6/1908 | O'Shaunessy | 2/161 A X |
| 2,011,362 | 8/1935 | Hayward | 273/54 B X |
| 2,738,190 | 3/1956 | Tureaud | 2/161 A X |
| 2,845,628 | 8/1958 | Dell | 273/1.5 A X |
| 3,123,832 | 3/1964 | Kubik | 273/54 B X |
| 3,496,573 | 2/1970 | Kuchar et al. | 273/1.5 A X |
| 3,501,773 | 3/1970 | Stansberry et al. | 273/1.5 A X |
| 3,640,532 | 2/1972 | Bauer | 273/1.5 A |
| 3,707,730 | 1/1973 | Slider | 273/161 A |

*Primary Examiner*—Paul E. Shapiro

*Attorney, Agent, or Firm*—Norman B. Rainer

[57] ABSTRACT

A training glove for basketball players has cut-off finger portions, a rigid arch plate incorporated into the palm portion, and a weight disposed upon the back portion. The arch plate trains the player not to contact the basketball with the palm of his hand, and causes the ball to be contacted by the spread fingers. The weight develops muscular strength through repeated use. With diligent use, the glove improves the accuracy and range for shooting the basketball through the hoop.

8 Claims, 2 Drawing Sheets

BASKETBALL PLAYER'S TRAINING GLOVE

BACKGROUND OF THE INVENTION

This invention relates to a glove, and more particularly concerns a glove designed to improve a basketball player's technique for throwing the basketball through the hoop.

In the game of basketball, skillful throwing or "shooting" the basketball through the hoop is achieved only with extensive practice and mastering of generally proven techniques. One objective of prolonged repetitious practice in actual shooting or in exercises which simulate shooting is to strengthen the several specific muscles involved in the shooting act.

An important aspect of generally accepted technique, especially in the "jump shot" where the ball is thrown by just one hand, is that the palm of the shooting hand should be arched so that the ball will be contacted by the fingertips and not by the palm. The proper amount of arching of the palm is generally acquired only after long experience and the attendant strengthening of the specific muscle groups involved.

U.S. Pat. No. 2,011,362 to Hayward discloses an athletic training glove having a weight incorporated therein for strengthening muscles utilized in swinging or striking motions of a bat or racket gripped by the palm and involving a rapid snap of the wrist. Although a weighted glove is useful for sports training purposes, the specific glove of Hayward is clearly unsuited for the training of basketball shooting techniques.

It is accordingly an object of the present invention to provide a glove useful for the training of basketball shooting technique.

It is another object of this invention to provide a glove as in the foregoing object having a weight incorporated therein to develop muscular strength without impairing normal hand mobility.

It is a further object of the present invention to provide a glove of the aforesaid nature which will constrain the palm and fingers of the hand to a desired configuration.

It is still another object of this invention to provide a glove of the aforesaid nature of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a glove, the thumb portion of which is truncated at the usual location of the second thumb joint, and the finger portions of which are truncated to the locations of the second joints of the phalanges. The palm and opposed back portions of the glove are constructed of a strong light weight fabric.

The finger portions are integral with a knuckle-covering portion fabricated of supple thin leather and sewn to said fabric. The palm portion has a rigid arch plate incorporated therein, and the back portion has a shaped weight incorporated therein adapted to rest upon the metacarpal bones of the back of the hand. The wrist portion of the glove is provided with adjustable strap means, preferably employing Velcro fastener material. The knuckle-covering portion preferably has four apertures to permit protrusion therethrough of the knuckles of the back of the hand. When used for a period of time as a training aid, the glove will improve the player's accuracy and will extend his shooting range.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
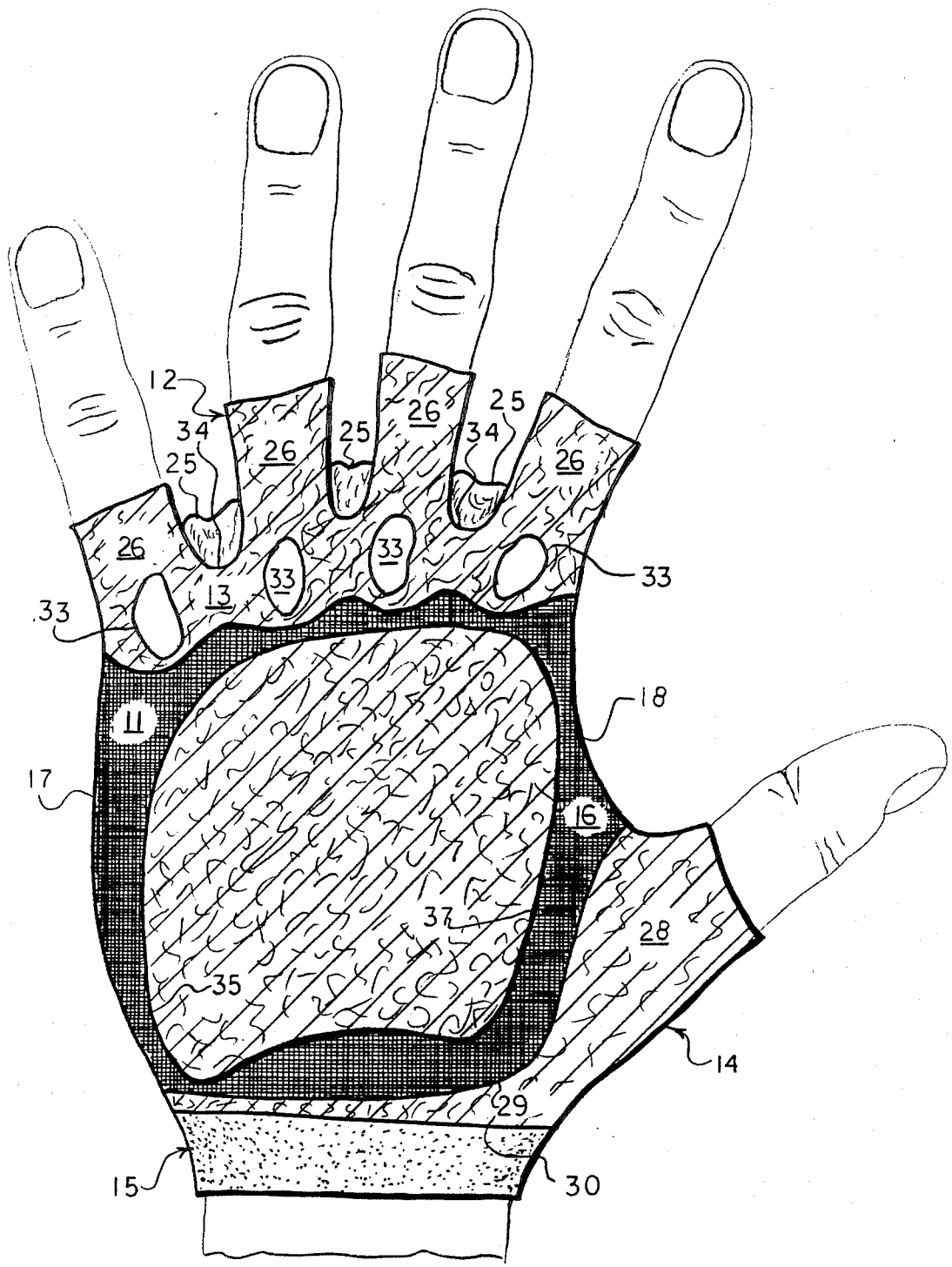
FIG. 1 is a view of the back or metacarpal side of an embodiment of a glove of the present invention.
Figure 2:
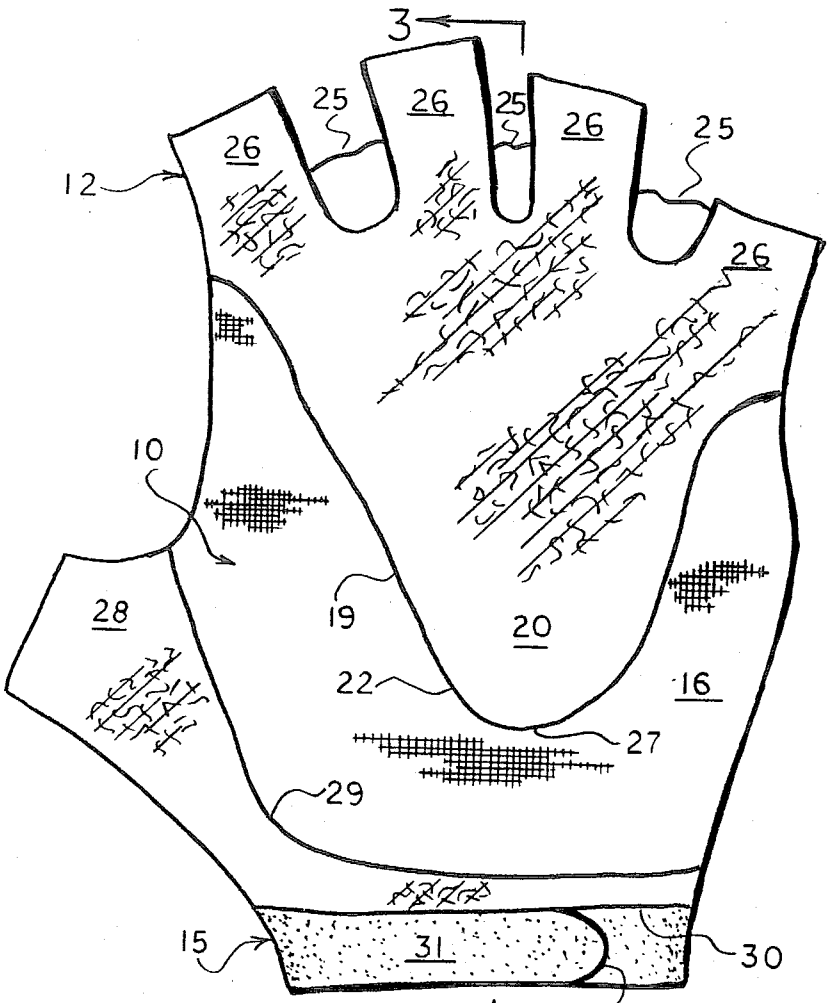
FIG. 2 is a view of the palm side of the glove of FIG. 1.
Figure 3:
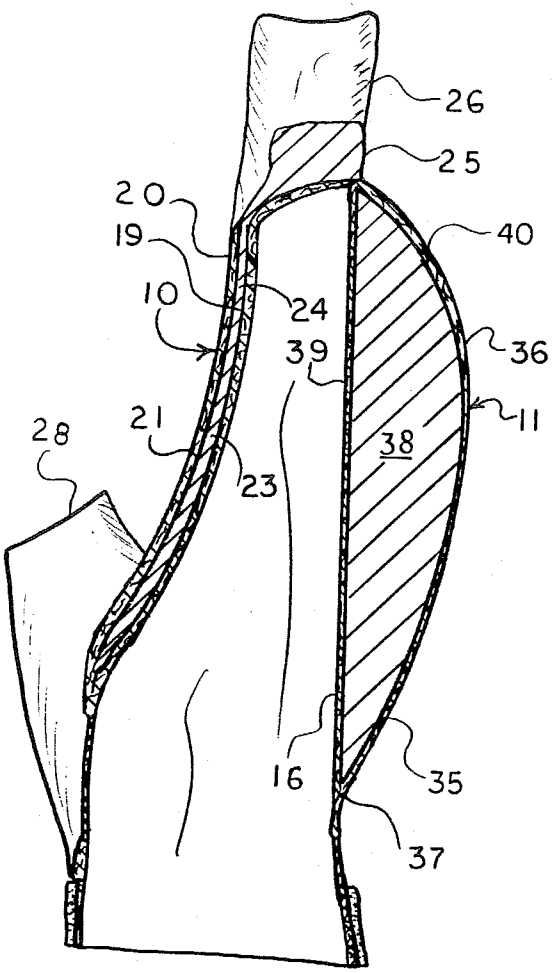
FIG. 3 is a vertical sectional view taken along the line 3—3 of FIG. 2.

Referring to FIGS. 1–3, an embodiment of the glove of the present invention intended to be worn on a left hand, is shown comprised of palm portion 10, back portion 11, finger portion 12 integrally combined with knuckle portion 13, thumb portion 14 and wrist portion 15.

An integral piece of light-weight, strong fabric 16 is utilized in a manner to circumscribe the hand, thereby forming both the palm and back portions, and additionally forming end portions 17 and 18 extending between said palm and back portions and integral therewith. One or more seams may however be disposed in fabric 16 along said end portions for fabricational simplification. The fabric may be comprised of nylon, polyester or other strong and durable synthetic fiber.

A first pocket 19 is disposed upon the interior face 21 of said palm portion, said pocket being formed by a first outer panel 20 fabricated of thin, supple leather and joined by seam line 22 to fabric 16. A rigid shaping structure 23 is retained by pocket 19, said shaping structure being comprised of arch cup portion 24 convexly contoured with respect to the interior of the glove, and three spacer portions 25 extending from the upper extremity of the arch cup into the area between the finger-accommodating sleeves 26 of finger portion 12. Shaping structure 23 is preferably a monolithic piece of plastic formed by a molding operation. The arch cup tapers downwardly to a narrowed and rounded lower extremity 27 disposed above the thumb muscle and above wrist portion 15.

Thumb portion 14, incorporating thumb sleeve 28, is preferably fabricated of a strong, thin, supple leather such as pig skin or calf skin. Thumb portion 14 is joined by sewing to the lower extremity 29 of fabric 16 and the upper extremity 30 of wrist portion 15.

Said wrist portion is comprised essentially of an adjustable strap 31 preferably having elastic characteristics. The extremity 32 of strap 31 contains on its underside Velcro fastener material adapted to engage matching Velcro material on the facing opposite portion of the strap.

Finger portion 12 is comprised of four finger-receiving sleeves 26 which are integral with leather panel 20 upon the palm portion of the glove. On the back portion 11, the sleeves are integral with knuckle portion 13 which is integral with panel 20 and extends as a region transverse to sleeves 26. Knuckle portion 13 is sewn to fabric 16 upon the back of the glove. Four apertures 33 are disposed in the knuckle portion in a manner to permit protrusion therethrough of the knuckles on the back of the hand. Slotted apertures 34 are disposed between sleeves 26, permitting penetration therethrough of spacer portions 25 of shaping structure 23. The combined finger and knuckle portion is fabricated of the same type of strong, thin, supple leather utilized for the thumb portion.

A second pocket 35 is disposed upon back portion 11, said pocket being formed by a second outer panel 36 fabricated of fabric or leather and joined by seam line 37 to fabric 16. A shaped weight 38, weighing about 3 pounds is confined within pocket 35. The weight, preferably fabricated of lead, has a substantially flat underside 39 adapted to rest upon the metacarpal bones of the back of the hand. Upper surface 40 of the weight is convexly contoured away from the glove, the thickness of the weight being greater adjacent the knuckles than adjacent the wrist portion.

Some internally disposed padding may be utilized to provide greater comfort. By virtue of the aforesaid features of construction, it is seen that the player's hand is constrained to have an arch on the palm side, and the fingers are spaced apart a proper distance. The weight on the back of the glove does not interfere with the usual basketball-handling manipulations, and provides muscular exercise. The glove can be made for left or right-handed players in various sizes. Shaped weight 38 may have a weight of between 1 and 5 pounds. In certain embodiments, second pocket 35 may be openable as by zipper means, thereby permitting interchangability of weight 38.

The training glove of this invention will strengthen the Extensor and Flexor muscles of the forearm, as well as the Triceps and Deltoid muscles. The arch cup forces the ball to the finger tip area to add strength there and assist in development of proper rotation, arch and followthrough. The strengthened wrist and fingertips that come from using the training glove aid in perfection of propulsion and control of the ball. Thus, the basketball player will gain accuracy over a more extensive range of distances in shooting the jump shot. It is expected that the device will find general use for basketball players in off season training of a weak hand to induce the coordination and evenhandedness equivalent to that of an ambidextrous player. This glove device will also have secondary benefits such as helping players undergoing rehabilitation for fractures and sprains of the wrist, fingers and other Carpus-oriented ailments.

The muscles aided by the weight in the training glove are those which are crucial to the jump shot. For example, the deltoid muscle is an important superficial muscle of the shoulder that is relatively large and has good leverage through the lateral plane of motion, along with motion versatility via relationships between this muscle and the shoulder joint. The latissimus dorsi, various flexor muscles, the upper pectoralis major and the anterior deltoid are among the other muscles involved in control of shoulder joint motion and shoulder extension.

The training glove also helps in the essential area of jump shot grip, as the arch cup sheltering the open palm shapes the contour of a perfectly arched hand and spreads the fingers apart to enable the player to properly cradle the basketball with the finger tips instead of the palm. This is important, as the good jump shot is released from the finger tips rather than from the palm.

The training glove also strengthens the wrist, which is crucial to the jump shot for many players.

There are numerous wrist muscles that can be strengthened by the training glove. For example, there are 15 extrinsic hand muscles located on the various aspects of the wrist joint. Included in the wrist muscles are 6 flexors, 7 extensors, 5 radial flexors and 2 ulnar flexors.

In addition, use of the training glove addresses the important metacarpophalangeal and interphalangeal joints involved in proper release of the basketball for the jump shot. Flexion, extension, abduction, adduction and circumduction are among the motions of the metacarpophalangeal joints. The structure of the interphalangeal joints limits them to flexion and extension.

Basically, the hand is like the foot in being equipped with two sets of muscles, with one group, the extrinsic hand muscles, having upper limb proximal attachments and distal attachments within the hand and the other group, the intrinsic hand muscles, attaching entirely within the hand.

The weighted training glove of this invention is especially helpful to young athletes with weak arms and wrist who fling the ball wildly at the basket. By using the training glove to give the wrist a complete and strenuous workout and influencing wrist action, the mechanics of the jump shot can be changed. The glove practically forces the shooter to bring the arm forward from behind the head for proper shot release from the finger tips.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A glove for use in training a basketball player in shooting a basketball, said glove comprising:

(a) a thumb portion for receiving the thumb of the hand, said thumb portion being truncated at the location of the second thumb joint, (b) a finger portion having four finger-accommodating sleeves for receiving the remaining four fingers of the hand, said sleeves being truncated to the locations of the second joints of the phalanges, (c) a palm portion having a rigid shaping structure incorporated therein, (d) a back portion having a shaped weight associated therewith and configured to rest upon the metacarpal bones of the back of the hand, (e) a wrist portion provided with adjustable strap means, and (f) a knuckle-covering portion integral with the finger portion and having four apertures to permit protrusion therethrough of the knuckles of the back of the hand.

2. The glove of claim 1 fabricated in part of lightweight porous strong fabric extending between said palm and back portions.

3. The glove of claim 2 wherein a first pocket is associated with said palm portion and retains said shaping structure.

4. The glove of claim 3 wherein said shaping structure is an integral member comprised of an arch cup portion convexly contoured with respect to the interior of the glove, and three spacer portions extending from the upper extremity of the arch cut portion into the area between the finger-accommodating sleeves.

5. The glove of claim 4 wherein said thumb and finger portions are fabricated of a strong, thin, supple leather joined by sewing to the fabric portion of the glove.

6. The glove of claim 5 wherein slotted apertures are disposed within the finger portion between adjacent sleeves to permit penetration therethrough of the spacer portions of the shaping structure.

7. The glove of claim 6 wherein a second pocket is disposed upon said back portion, and accommodates said shaped weight.

8. The glove of claim 7 wherein said shaped weight has a substantially flat underside and an upper surface which is convexly contoured away from the glove.

* * * * *